US006752890B2

(12) United States Patent
Paquin

(10) Patent No.: US 6,752,890 B2
(45) Date of Patent: Jun. 22, 2004

(54) METHOD OF MANUFACTURING A PRESS FABRIC BY SPIRALLY ATTACHING A TOP LAMINATE LAYER WITH A HEAT-ACTIVATED ADHESIVE

(75) Inventor: Maurice R. Paquin, Averill Park, NY (US)

(73) Assignee: Albany International Corp., Albany, NY (US)

( * ) Notice: Subject to any disclaimer, the term of this patent is extended or adjusted under 35 U.S.C. 154(b) by 165 days.

(21) Appl. No.: 10/016,581

(22) Filed: Nov. 1, 2001

(65) Prior Publication Data

US 2002/0053391 A1 May 9, 2002

Related U.S. Application Data

(63) Continuation of application No. 09/337,749, filed on Jun. 22, 1999, now Pat. No. 6,350,336.

(51) Int. Cl.[7] ..... B32B 31/00

(52) U.S. Cl. ..... 156/187; 156/195; 156/93; 156/192; 156/304.6; 156/304.1; 156/460; 156/446; 156/308.2; 162/900; 162/358.2; 162/358.1; 28/110; 28/135

(58) Field of Search ..... 156/304.1, 137, 156/157, 187, 195, 267, 429, 428, 425, 446, 459, 460, 93, 192, 193, 304.6, 308.2; 162/900, 358.2, 358.1; 28/110, 135

(56) References Cited

U.S. PATENT DOCUMENTS

| | | | | | |
|---|---|---|---|---|---|
| 1,651,476 | A | * | 12/1927 | Sheehan | 162/359.1 |
| 4,427,734 | A | * | 1/1984 | Johnson | 442/324 |
| 4,446,187 | A | * | 5/1984 | Eklund | 428/136 |
| 5,171,389 | A | * | 12/1992 | Stigberg | 156/165 |
| 5,360,656 | A | * | 11/1994 | Rexfelt et al. | 428/193 |
| 5,396,755 | A | * | 3/1995 | Arnold | 53/16.4 B |
| 6,350,336 | B1 | * | 2/2002 | Paquin | 156/93 |

* cited by examiner

*Primary Examiner*—Linda Gray
(74) *Attorney, Agent, or Firm*—Frommer Lawrence & Haug LLP; Ronald R. Santucci

(57) ABSTRACT

A method for manufacturing a press fabric for a paper machine includes the attachment of a strip of top laminate layer material to a base fabric using a heat-activated adhesive film. The top laminate layer material may be a woven fabric, a nonwoven mesh, or a thermoplastic sheet material, and, in any case, has the heat-activated adhesive film bonded to one of its two sides. The strip of top laminate layer material and heat-activated adhesive film together form a multi-component strip, which is spiralled onto the outer surface of the base fabric, with the side of the strip of top laminate layer material having the heat-activated adhesive film against the outer surface, in a closed helix, and bonded thereto with heat and pressure. The portions of the multi-component strip overhanging the lateral edges of the base fabric are then trimmed, and a staple fiber batt is needled into and through the top laminate layer formed by the multi-component strip to firmly attach it to the base fabric.

21 Claims, 4 Drawing Sheets

METHOD OF MANUFACTURING A PRESS FABRIC BY SPIRALLY ATTACHING A TOP LAMINATE LAYER WITH A HEAT-ACTIVATED ADHESIVE

CROSS-REFERENCE TO RELATED APPLICATION

This is a continuation of U.S. patent application Ser. No. 09/337,749, filed Jun. 22, 1999, now U.S. Pat. No. 6,350,336.

BACKGROUND OF THE INVENTION

1. Field of the Invention

The present invention relates to the papermaking arts. More specifically, the present invention is a method for manufacturing a papermaker's press fabric wherein a top laminate layer is applied to a base fabric thereof in a spiral configuration and attached thereto with a heat-activated adhesive.

2. Description of the Prior Art

During the papermaking process, a fibrous web is formed by depositing a fibrous slurry, that is, an aqueous dispersion of cellulose fibers, on a moving forming fabric in the forming section of a paper machine. A large amount of water is drained from the slurry through the forming fabric during this process, leaving the fibrous web on the surface of the forming fabric.

The newly formed web proceeds from the forming section to a press section, which includes a series of press nips. The fibrous web passes through the press nips supported by a press fabric, or, as is often the case, between two press fabrics. In the press nips, the fibrous web is subjected to compressive forces which squeeze water therefrom, and which adhere the fibers in the web to one another to turn the fibrous web into a sheet. The water is accepted by the press fabric or fabrics and, ideally, does not return to the sheet.

The newly formed paper sheet finally proceeds to a dryer section, which includes at least one series of rotatable dryer drums or cylinders, which are internally heated by steam. The sheet is directed in a sinuous path sequentially around each in the series of drums by a dryer fabric, which holds the sheet closely against the surfaces of the drums. The heated drums reduce the water content of the sheet to a desirable level through evaporation, thereby completing the transformation of the fibrous web into a paper sheet.

It should be appreciated that the forming, press and dryer fabrics all take the form of endless loops on the paper machine and function in the manner of conveyors. It should further be appreciated that paper manufacture is a continuous process which proceeds at considerable speed. That is to say, the fibrous slurry is continuously deposited onto the forming fabric in the forming section, while a newly manufactured paper sheet is continuously wound onto rolls after it exits from the dryer section.

The press fabrics used in the press section are crucial components in the paper manufacturing process. One of their functions, as implied above, is to support and to carry the paper product being manufactured through the press nips.

The press fabrics also take part in the finishing of the surface of the paper sheet. That is, the press fabrics are designed to have smooth surfaces and uniformly resilient structures, so that, in the course of passing through the press nips, a smooth, mark-free surface is imparted to the paper.

Perhaps most importantly, the press fabrics accept the large quantities of water extracted from the wet paper in the press nip. In order to fill this particular function, there literally must be space (void volume) within the fabric for the water to go, and the fabric must have adequate permeability to water for its entire useful life. Finally, the press fabrics must be able to retain the water accepted from the wet paper upon exit from the press nip, so that the water will not rewet the paper.

Contemporary press fabrics are produced in a wide variety of styles designed to meet the requirements of the paper machines on which they are installed for the paper grades being manufactured. Generally, they comprise a woven base fabric into which has been needled a batt of fine, nonwoven fibrous material. The base fabrics may be woven from monofilament, plied monofilament, multifilament or plied multifilament yarns, and may be single-layered, multi-layered or laminated. The yarns are typically extruded from any one of the synthetic polymeric resins, such as polyamide and polyester resins, used for this purpose by those of ordinary skill in the paper machine clothing arts.

The woven base fabrics themselves take many different forms. For example, they may be woven endless, or flat woven and rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back-and-forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing one base fabric within the endless loop of another, and by needling a staple fiber batt through both base fabrics to join them to one another. One or both woven base fabrics may be of the on-machine-seamable type.

Moreover, a woven base fabric may be produced by spirally winding a woven fabric strip in accordance with the teachings of commonly assigned U.S. Pat. No. 5,360,656 to Rexfelt et al., the teachings of which are incorporated herein by reference.

Laminated base fabrics may also be produced by applying a top laminate layer to a woven base fabric of any of the above-noted types using the spiral manufacturing technique disclosed in U.S. Pat. No. 5,360,656. The top laminate layer may be a spirally wound flat-woven fabric strip; a strip of thermoplastic sheet material, such as, of polyurethane; or a strip of nonwoven mesh, such as that disclosed in commonly assigned U.S. Pat. No. 4,427,734 to Johnson, the teachings of which are also incorporated herein by reference. In each case, the width of the strip is much less than that of the woven base fabric, and several spiral turns thereof are required to completely cover the base fabric. Such top laminate strips have traditionally been prejoined to each other in a length and width required for a full-size press fabric. This full-width top laminate layer is then attached to the base fabric by needling a staple fiber batt into and through both layers to form a laminated base fabric. Ultimately, the batt is the main means for locking the top laminate layer to the base fabric.

The present invention is an improvement in the attachment of a top laminate layer to a base fabric, wherein the top laminate layer comprises at least one multi-component strip of material spiralled onto the base fabric, one of the components being a heat-activated adhesive.

SUMMARY OF THE INVENTION

Accordingly, the present invention is a method for manufacturing a press fabric for a paper machine wherein a top laminate layer is attached to a base fabric in a spiral manufacturing process using a heat-activated adhesive film.

More specifically, the present invention comprises the step of providing a base fabric for the press fabric. The base fabric may be of any of the standard varieties heretofore described, and is in the form of an endless loop having an inner surface, an outer surface, a first and second lateral edge, and a fabric width measured transversely between the lateral edges.

A multi-component strip for covering the outer surface of the base fabric in a closed helix is also provided. The multi-component strip has a beginning, a first lateral edge, a second lateral edge, and a strip width measured thereacross. The strip width is generally much less than the fabric width. The multi-component strip comprises at least a strip of top laminate layer material and a heat-activated adhesive film bonded to one side of the strip of top laminate layer material. The strip of top laminate layer material may be, for example, a woven fabric, a nonwoven mesh, or a sheet of thermoplastic material, such as of polyurethane.

The heat-activated adhesive film is used to attach the strip of top laminate layer material to the base fabric. To start the attachment process, the beginning of the multi-component strip is attached to the outer surface of the base fabric at a point on the first lateral edge thereof using heat and pressure. The side of the strip of top laminate layer material having the heat-activated adhesive film faces the base fabric during this process. The multi-component strip is oriented at a slight angle with respect to the first lateral edge, so that it may be spiralled onto the base fabric to completely cover it in a closed helix.

Continuing from the beginning of the multi-component strip, the side of the strip of top laminate layer material having the heat-activated adhesive film is attached to the outer surface of the base fabric in a closed helix having a plurality of turns using heat and pressure, wherein the first lateral edge of the turn of the multi-component strip being attached abuts against the second lateral edge of the turn of the multi-component strip previously attached to the outer surface, until the outer surface of the base fabric is completely covered by the strip in a closed helix. The multi-component strip is then cut at a point on the second lateral edge of the base fabric.

The present invention will now be described in more complete detail with frequent reference being made to the drawings identified hereinbelow.

DETAILED DESCRIPTION OF THE PREFERRED EMBODIMENT

Figure 1:
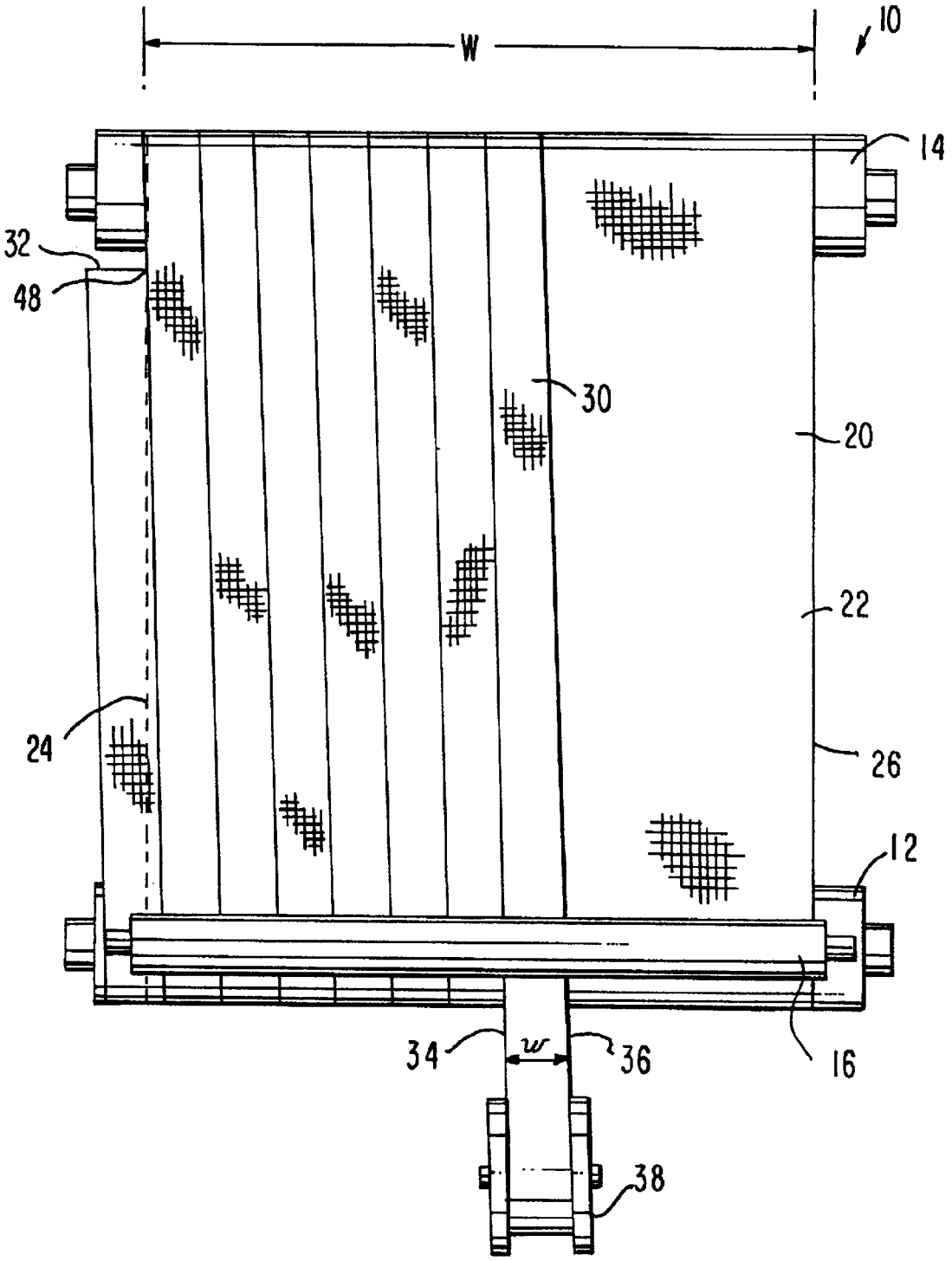
FIG. 1 is a plan view of an apparatus which may be used to practice the present method for manufacturing a press fabric for a paper machine.

Turning now to the figures, FIG. 1 is a plan view of an apparatus 10 which may be used to practice the present invention. Apparatus 10 includes a first process roll 12 and a second process roll 14, each of which is rotatable about its longitudinal axis. The first process roll 12 and the second process roll 14 are parallel to one another, and may be moved and set at any number of fixed distances from one another. The first process roll 12 may be a heated roll. The apparatus 10 may be a dryer or heat-setting device with a heated roll, or may be part of a needle loom.

The manufacturing process is begun by mounting a base fabric 20 for a press fabric around the first and second process rolls 12, 14. The base fabric 20 is in the form of an endless loop having an inner surface, which is not visible in the figure, an outer surface 22, a first lateral edge 24 and a second lateral edge 26. The width, W, of the base fabric 20 is measured transversely thereacross between the first and second lateral edges 24, 26. It will be observed that the first and second process rolls 12, 14 are within the endless loop formed by the base fabric 20. Once the base fabric 20 is so mounted, the first and second process rolls 12, 14 are moved apart from one another, and set at fixed positions such that the base fabric 20 may be placed under tension.

It should be understood that prior to being mounted about first and second process rolls 12,14, the base fabric 20 may be turned inside out to place the surface intended to be on the inside when the press fabric being manufactured is on the paper machine on the outside for the process of the present invention. In this regard, the terms "inner surface" and "outer surface" denote the surfaces of the base fabric 20 when it is disposed about first and second process rolls 12,14, and not necessarily those when the base fabric 20 is on a paper machine.

Figure 2:
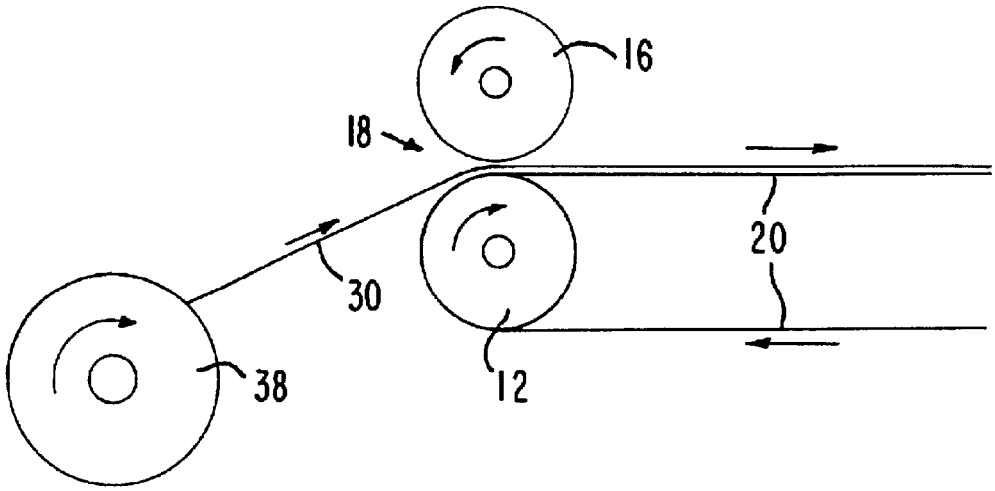
FIG. 2 is a side view of the nip formed by the heated roll and the pressure roll of the apparatus.

A pressure roll 16 is also included in apparatus 10 adjacent to and forming a nip 18 with first process roll 12. Nip 18 is more readily seen in FIG. 2, which is a side view of the first process roll 12 and pressure roll 16. The latter is so positioned that it presses base fabric 20 against the first process roll 12, which, it will be recalled, may be a heated roll.

A multi-component strip 30 is provided for covering the outer surface 22 of the base fabric 20 in a closed helix. The multi-component strip 30 has a beginning 32, a first lateral edge 34 and a second lateral edge 36. The width, w, of the multi-component strip 30 is measured transversely thereacross between the first and second lateral edges 34, 36, and is less than the width, W, of the base fabric 20.

Figure 3A:
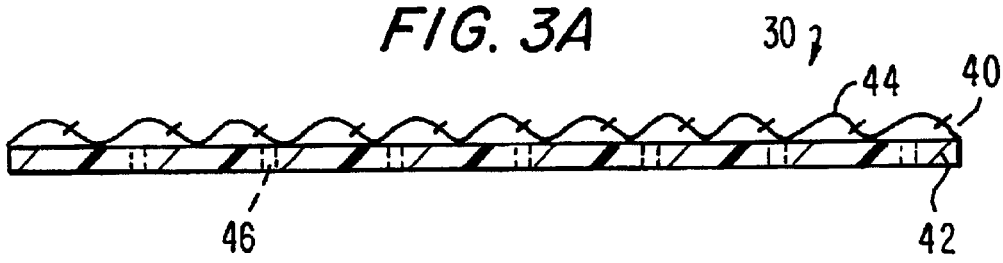
FIG. 3A is a schematic cross-sectional view of a multi-component strip used in the practice of the present invention.
Figure 3B:
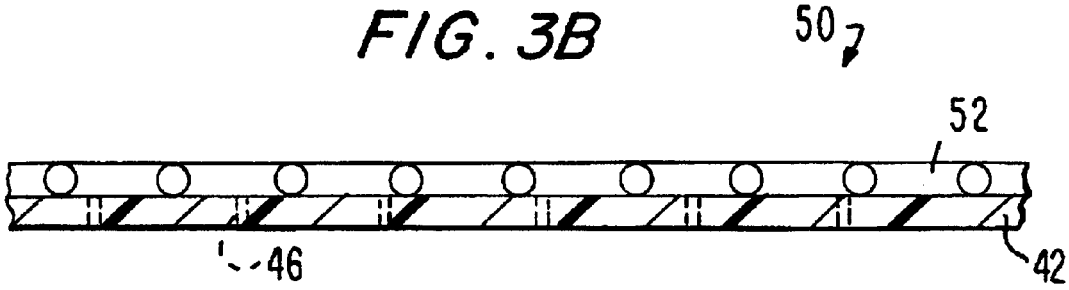
FIGS. 3B and 3C are schematic cross-sectional views of two alternate embodiments of the multi-component strip.
Figure 3C:
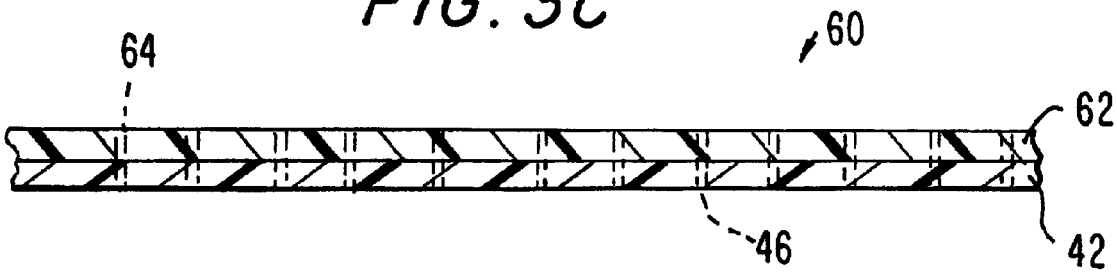

As shown in FIG. 3A, a schematic cross-sectional view of a multi-component strip used in the practice of the present invention, the multi-component strip 30 comprises a strip 40 of top laminate layer material and a heat-activated adhesive film 42 bonded to one side of the strip 40 of top laminate layer material. That is to say, multi-component strip 30 comprises a strip of woven fabric 44 bonded to a heat-activated adhesive film 42. FIGS. 3B and 3C are cross-sectional views of two alternate embodiments of the multi-component strip. In FIG. 3B, multi-component strip 50 comprises a strip of nonwoven mesh 52 bonded to heat-activated adhesive film 42, and, in FIG. 3C, multi-component strip 60 comprises a strip of thermoplastic sheet material 62, such as of polyurethane, bonded to a heat-activated adhesive film 42. Nonwoven mesh 52 may be obtained from Naltex. The strip of thermoplastic sheet material 62 and the heat-activated adhesive film 42 are preferably apertured to facilitate the passage of water therethrough. The aperturing may be carried out during the needling of a staple fiber batt into and through the multi-component strips 30,50,60, once they have been attached to the base fabric 20. Alternatively, the aperturing may be carried out prior to attaching multi-component strips 30,50, 60 to the base fabric 20. In such case, the individual apertures 46,64 may be of any geometric shape, such as circular, elliptical, square, rectangular, diamond-shaped and so forth, and may be arranged through the heat-activated adhesive film 42 or the multi-component strip 60 in any pattern suitable for the performance of the press fabric. Where the heat-activated adhesive film 42 is attached to a porous layer, such as the woven fabric 44 shown in FIG. 3A or the nonwoven mesh 52 shown in FIG. 3B, the heat-activated adhesive film 42 may be so apertured prior to its attachment thereto. On the other hand, where the heat-activated adhesive film 42 is attached to a strip of thermoplastic sheet material 62, as is shown in FIG. 3C, they may be apertured after they are attached to one another and before they are attached to the base fabric 20. The heat-activated adhesive film 42 and the strip of thermoplastic sheet material 62 may be formed in one step by coextrusion, and the coextruded multi-component strip 60 apertured prior to its attachment to base fabric 20.

Referring back to FIGS. 1 and 2, multi-component strip 30, as well as multi-component strips 50,60 may be dispensed from a supply roll 38. The beginning 32 of the multi-component strip 30 is attached to a point 48 on the first lateral edge 24 of the standard base fabric 20. More precisely, the second lateral edge 36 at the beginning 32 of the multi-component strip 30 is attached to point 48 with the heat-activated adhesive film 42 in contact with the outer surface 22 of the base fabric 20. Heat and pressure, provided by first process roll 12 and pressure roll 16 at nip 18, respectively, may be used to bring about the attachment.

The first process roll 12 and the second process roll 14 are rotated in a common direction during the manufacturing process while the multi-component strip 30 is fed from supply roll 38 to completely cover the outer surface 22 of the base fabric 20 in a closed helix. Heat and pressure, provided by first process roll 12 and pressure roll 16 at nip 18, respectively, attach the multi-component strip 30 to the outer surface 22. The first lateral edge 34 of each turn of the multi-component strip 30 being attached abuts against the second lateral edge 36 of the turn of the strip 30 previously attached to the outer surface 22, until the outer surface 22 of the standard base fabric 20 is completely covered by the strip 30 in a closed helix.

As an alternative to, or in addition to, the use of a heated first process roll 12, hot air may be directed into nip 18 between base fabric 20 and multi-component strip 30 to soften the heat-activated adhesive film 42 prior to its passage through nip 18. An infrared heater directed at the multi-component strip 30 at a point before it enters nip 18 could be used to accomplish the same result. Alternatively, pressure roll 16 may be a heated roll.

As a further alternative, the heat source, such as hot air or an infrared heater, may be included in a module which traverses along first process roll 12 with supply roll 38 as the multi-component strip 30 is being dispensed therefrom, rather than heating continuously across the full width of the base fabric 20 for the entire laminating process. Such a traversing module could include a pressure roll for use instead of the full-width pressure roll 16.

Figure 4:
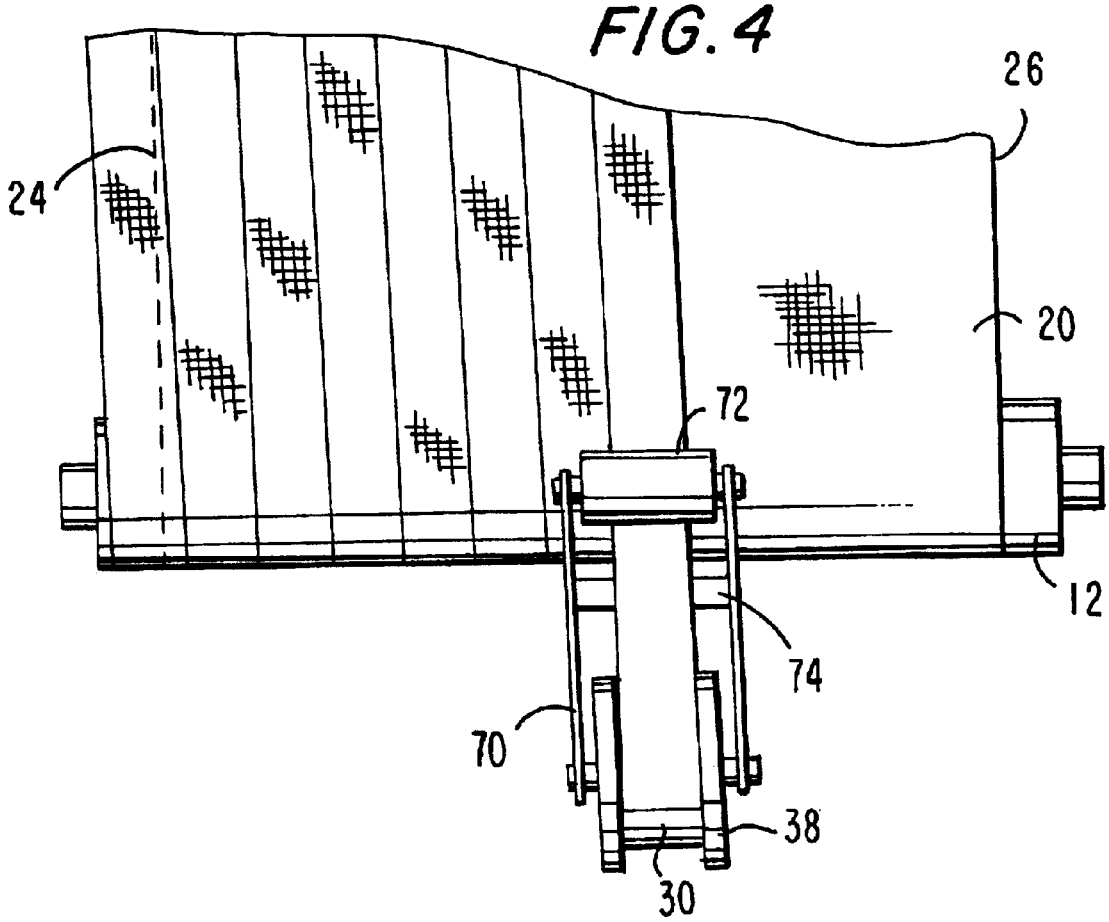
FIG. 4 is a plan view of a portion of an alternate embodiment of the apparatus, used to practice the present invention and incorporating a traversing module.
Figure 5:
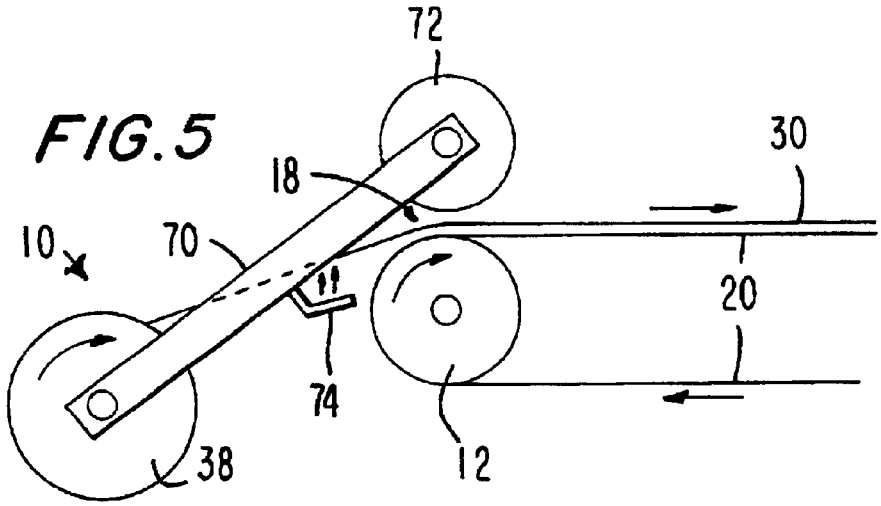
FIG. 5 is a side view of the portion of the alternate embodiment of the apparatus shown in FIG. 4.

More specifically, FIG. 4 is a plan view of an alternate embodiment of the apparatus 10. Instead of full-width pressure roll 16, a traversing module 70, which includes supply roll 38, has a pressure roll 72 of a width somewhat greater than that of the multi-component strip 30. A heat source 74, such as a source of hot air or infrared radiation, is also carried on traversing module 70 and heats multi-component strip 30 before it enters nip 18. FIG. 5 is a side view of the apparatus 10 as shown in FIG. 4 and shows the traversing module 70 and its components more clearly.

When the entire outer surface 22 of the base fabric 20 is completely covered by the multi-component strip 30, the strip 30 is cut at a point on the second lateral edge 26 of the base fabric 20. Because the multi-component strip 30 is spiralled onto the outer surface 22 of the base fabric 20, portions thereof will extend laterally beyond the first and second lateral edges 24, 26 of the base fabric 20. These portions may be trimmed along the first and second lateral edges 24, 26 at the conclusion of the manufacturing process.

Finally, a staple fiber batt may be needled into and through the top laminate layer formed by the multi-component strip 30 to firmly and permanently attach it to the base fabric 20. The staple fiber batt at this point becomes the main means connecting the top laminate layer to the base fabric 20. A staple fiber batt may also be attached to the other side (the inner surface) of the base fabric 20.

After staple fiber batt has been needled into one or both sides of the base fabric 20, the press fabric so obtained, comprising base fabric 20, top laminate layer formed by multi-component strip 30 and staple fiber batt, may again be exposed to heat, which would reactivate the heat-activated adhesive film 42 and improve the bonding of the base fabric 20, top laminate layer formed by multi-component strip 30 and the staple fiber batt together.

Finally, the press fabric so manufactured may be turned inside out upon its removal from the first and second process rolls 12,14 to place the surface having the top laminate layer formed by the multi-component strip 30 attached thereto on the inside of the press fabric for use on a paper machine.

Modifications to the above would be obvious to those of ordinary skill in the art, but would not bring the invention so modified beyond the scope of the appended claims.

The present invention eliminates the problem of matching the length of the top laminate layer to that of the base fabric. Because the top laminate layer is spiralled onto the base fabric, its length will appropriately match that of the base fabric. Moreover, the manufacture of laminated press fabrics in accordance with the present invention greatly facilitates manufacture, as the strip of top laminate layer material can be made in quantity in advance of its actual need. Further, the use of a heat-activated adhesive film permits the use of top laminate layer materials that would be otherwise difficult to use. Finally, the heat-activated adhesive film keeps the top laminate layer in its proper position, and prevents it from migrating during needling.

What is claimed is:

1. A method for manufacturing a press fabric for a paper machine, said method comprising:

providing a base fabric for said press fabric, said base fabric being in the form of an endless loop, said endless loop having an inner surface, an outer surface, a first and a second lateral edge, and a fabric width measured transversely between said lateral edges;

providing a strip of top laminate layer material for covering said outer surface of said base fabric in a closed helix, said strip having a beginning, a first lateral edge and a second lateral edge, a strip width measured transversely thereacross, said strip width being less than said fabric width;

attaching a heat-activated adhesive film to one side of said strip of top laminate layer material to form a multi-component strip;

attaching said side of said strip of top laminate layer material having said heat-activated adhesive film at said beginning of said multi-component strip to said outer surface of said base fabric at a point on said first lateral edge of said base fabric using heat and pressure;

continuing from said beginning of said multi-component strip, attaching said side of said strip of top laminate layer material having said heat-activated adhesive film to said outer surface of said base fabric in a closed helix having a plurality of turns using heat and pressure, wherein said first lateral edge of a turn of said multi-component strip being attached to said outer surface abuts against said second lateral edge of a turn of said multi-component strip previously attached to said outer surface, until said outer surface of said base fabric is completely covered by said multi-component strip in a closed helix; and cutting said multi-component strip at a point on said second lateral edge of said base fabric, whereby said multi-component strip forms a top laminate layer on said base fabric.

2. A method as claimed in claim 1 wherein said strip of top laminate layer material is a woven fabric.

3. A method as claimed in claim 1 wherein said strip of top laminate layer material is a nonwoven mesh.

4. A method as claimed in claim 1 wherein said strip of top laminate layer is a strip of thermoplastic sheet material.

5. A method as claimed in claim 4 wherein said thermoplastic sheet material is of polyurethane.

6. A method as claimed in claim 4 further comprising the step of aperturing said strip of thermoplastic sheet material.

7. A method as claimed in claim 1 wherein said heat-activated adhesive film is apertured.

8. A method as claimed in claim 1 further comprising the step of needling a staple fiber batt into said top laminate layer formed by said multi-component strip after attaching said strip to said base fabric.

9. A method as claimed in claim 1 further comprising the step, after said base fabric is completely covered by said multi-component strip in a closed helix to form said top laminate layer, of trimming said multi-component strip along said first and second lateral edges of said base fabric.

10. A method as claimed in claim 1 further comprising the steps of:

providing a first and a second process roll, said first and second process rolls being rotatable about their respective axes and said axes being parallel to one another;

mounting said base fabric around said first and second process rolls, said first and second process rolls thereby being within said endless loop of said base fabric;

separating said first and second process rolls from one another to fixed positions, said base fabric thereby being placed under tension;

providing a pressure roll, said pressure roll forming a nip with said first process roll and pressing said base fabric against said first process roll;

rotating said first and second process rolls in a common direction;

heating said multi-component strip to activate said heat-activated adhesive film;

feeding said beginning of said multi-component strip into said nip at said first lateral edge of said base fabric, thereby attaching said top laminate layer at said beginning of said strip to said outer surface of said base fabric at a point on said first lateral edge thereof;

continuing to rotate said first and second process rolls in a common direction while feeding said multi-component strip into said nip, thereby attaching said top laminate layer to said outer surface of said base fabric in a closed helix, until said outer surface of said base fabric is completely covered by said strip in a closed helix.

11. A method as claimed in claim 10 further comprising the step of dispensing said multi-component strip from a supply roll.

12. A method as claimed in claim 10 further comprising the step of turning said base fabric inside out before mounting said base fabric around said first and second process rolls.

13. A method as claimed in claim 10 further comprising the step of removing said base fabric from said first and second process rolls after said outer surface thereof is completely covered by said multi-component strip.

14. A method as claimed in claim 13 further comprising the step of turning said base fabric inside out to place said top laminate layer formed by said multi-component strip on the inside thereof.

15. A method as claimed in claim 10 wherein said heating step is performed by using a heated first process roll.

16. A method as claimed in claim 10 wherein said heating step is performed by using a heated pressure roll.

17. A method as claimed in claim 10 wherein said heating step is performed by directing a flow of hot air into said nip between said multi-component strip and said base fabric.

18. A method as claimed in claim 10 wherein said heating step is performed by using an infrared heater to heat said heat-activated adhesive film of said multi-component strip before said multi-component film enters said nip.

19. A method as claimed in claim 10 wherein said pressure roll extends at least for said fabric width.

20. A method as claimed in claim 10 wherein said pressure roll is shorter than said fabric width.

21. A method as claimed in claim 8 further comprising the step of heating said base fabric and said top laminate layer formed by said multi-component strip after needling said staple fiber batt therethrough to reactivate said heat-activated adhesive film and to further connect said staple fiber batt, said top laminate layer and said base fabric together.

* * * * *